US007862314B2

(12) United States Patent
Chiba et al.

(10) Patent No.: US 7,862,314 B2
(45) Date of Patent: Jan. 4, 2011

(54) SCREW COMPRESSOR

(75) Inventors: Kohtaro Chiba, Hitachinaka (JP); Hirotaka Kameya, Tsuchiura (JP); Hideharu Tanaka, Shizuoka (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 571 days.

(21) Appl. No.: 11/843,691

(22) Filed: Aug. 23, 2007

(65) Prior Publication Data

US 2008/0080997 A1 Apr. 3, 2008

(30) Foreign Application Priority Data

Sep. 28, 2006 (JP) ..... 2006-264232

(51) Int. Cl.
*F01C 21/00* (2006.01)
*F03C 2/00* (2006.01)
*F03C 4/00* (2006.01)

(52) U.S. Cl. ..... 418/189; 418/201.3

(58) Field of Classification Search ..... 418/189, 418/190, 201.1, 201.3, 206.1, 206.4, 206.5
See application file for complete search history.

(56) References Cited

U.S. PATENT DOCUMENTS 3,423,017 A * 1/1969 Schibbye et al. ..... 418/201.3
4,560,333 A 12/1985 Fujiwara et al.
6,257,855 B1 * 7/2001 Kameya et al. ..... 418/201.3

FOREIGN PATENT DOCUMENTS

JP 58-131388 8/1983
JP 62-358 7/1987

OTHER PUBLICATIONS

Chinese Office Action of Appln. 200710142405.9 dated Dec. 19, 2008.

* cited by examiner

*Primary Examiner*—Theresa Trieu
(74) *Attorney, Agent, or Firm*—Antonelli, Terry, Stout & Kraus, LLP.

(57) ABSTRACT

A screw compressor rotatably accommodates, within a casing including a suction port and a delivery port, a pair of female and male rotors under the meshed state and compresses gas in the state where a liquid is mixed by pouring the liquid to the gas confined within a working chamber formed with both rotors and the casing. On the wall surface of the casing opposing to the rotor delivery end, a recessed part is provided. The working chamber is communicated with the recessed part immediately before isolating from the delivery port and this communication is maintained until a volume of the working chamber substantially becomes zero. Thereby, the screw compressor can be control increase in power consumption, vibration, and noise.

15 Claims, 3 Drawing Sheets

SCREW COMPRESSOR

CLAIM OF PRIORITY

The present application claims priority from Japanese application JP 2006-264232 filed on Sep. 28, 2006, the content of which is hereby incorporated by reference into this application.

BACKGROUND OF THE INVENTION (1) Field of the Invention

The present invention relates to screw compressor and more specifically to a screw compressor for compressing gas in the state where liquid is mixed to the gas.

(2) Description of the Related Art

A general screw compressor in the related art will be explained with reference to FIG. 5 and FIG. 6. FIG. 5 is a cross-sectional view of a delivery end in the state immediately before delivery completion of a general screw compressor in the related art. FIG. 6 is an enlarged cross-sectional view of the delivery end in the state at the moment of delivery completion in FIG. 5.

In the screw compressor, a pair of female rotor 1 and a male rotor 2 are accommodated within a bore 21 of a casing 20 indicated with a broken line to respectively rotate in the arrow mark direction, and are meshed with each other as shown in FIG. 5. With progress in rotation of both rotors 1 and 2, gas within a groove operating as a working chamber is compressed and is delivered to a delivery chamber (not shown) through a delivery port 3.

At the meshed area of both rotors 1 and 2, a working chamber 7 and a working chamber 8 are formed and respectively include a contact point 4 and a contact point 5, a contact point 4 and a contact point 6 at both ends thereof.

One working chamber 7 is formed in the adequate groove shape while those volumes are expanded in association with rotation of the rotors 1 and 2. This working chamber 7 is communicated with a suction port (not shown) at the other ends of the rotors 1, 2.

The other working chamber 8 is formed in the adequate groove shape while gradually reducing in the volume. This working chamber 8 becomes a closed space for external side, except for the delivery port 3, immediately before the delivery completion. Liquid is poured to the working chamber 8 for cooling the gas in the compression process and hermetically sealing a clearance of the working chamber that will resulting in internal leak, and the gas mixed with the liquid is compressed in the working chamber 8. In the delivery process, since the gas having the density smaller than that of the liquid is delivered previously, the working chamber 8 is filled with the liquid immediately before the delivery completion, and the gas is almost ruled out.

When the rotors 1, 2 further rotate, the working chamber 8 changes into a closed working chamber 9 because it is isolated from the delivery port 3 as shown in FIG. 6. Even when the volume of the closed working chamber 9 is further reduced after the rotors 1, 2 further rotate, an exit of liquid is not provided within the interior. Therefore, this is the possibility that not only pressure within the closed working chamber 9 is likely to rise rapidly and vibration and noise are likely to be generated, but also damage of rotor and shortening in operation life of a bearing are likely to be caused.

Therefore, Japanese Examined Patent Application Publication No. S62-358 (Patent document 1) discloses another screw compressor. This screw compressor eliminates confinement of liquid and reduces vibration and noise level by providing a recessed part on an internal wall surface opposing to a rotor delivery end of a casing, forming an area of contour of the recessed part in the shape substantially conforming to a shape of a preceding flank of a groove forming a closed working chamber of a female rotor when the working chamber is isolated from the delivery port to form the closed working chamber, and by communicating the closed working chamber and the recessed part after the working chamber is isolated from the delivery port and changes into the closed working chamber.

[Patent Document 1] Japanese Examined Patent

In the screw compressor of the patent document 1, the closed working chamber and the recessed part are communicated with each other after the working chamber is isolated from the delivery port and changes into the closed working area, not considering that an internal pressure of the working chamber becomes very high immediately before the working chamber is isolated from the delivery port.

That is, since the gas having the density that is smaller than that of the liquid is delivered previously in the delivery process, the working chamber immediately before isolating from the delivery port is filled with the liquid and therefore the gas is almost ruled out. Accordingly, since the liquid is delivered through an extremely narrow communicating region between the delivery port having a reduced area and the working chamber immediately before the working chamber is isolated from the delivery port, it has become obvious that several problems are generated with inclusion of sharp increment in internal pressure of the working chamber, intermittent increase in torque for driving the rotors, and resultant increase in power consumption, vibration, and noise.

Here, the screw compressor in the patent document 1 has been limited only to a screw compressor where the closed working chamber is formed because the working chamber is isolated from the delivery port immediately before the delivery completion. Therefore, such screw compressor has a problem that it cannot be applied to the screw compressor where a volume of the working chamber substantially becomes zero at the moment when the working chamber is isolated from the delivery port.

SUMMARY OF THE INVENTION

An object of the present invention is therefore to provide a screw compressor for controlling increase in power consumption, vibration, and noise.

In order to achieve the object described above, the present invention proposes a screw compressor rotatably accommodating a pair of male and female rotors under the meshed state within a casing including a suction port and a delivery port to compress gas in the state of mixing a liquid through pouring of the liquid to the gas confined within a working chamber formed of both rotors and the casing, wherein, a recessed part is formed on a wall surface opposing to a rotor delivery end of the casing, the working chamber is communicated with the recessed part immediately before isolating from the delivery port, and the communication is maintained until a volume of the working chamber substantially becomes zero.

More preferable examples in structure of the present invention are as follows.

(1) The working chamber is isolated from the delivery port before a volume thereof substantially becomes zero.

(2) An area, a part of the contour of the recessed part, that contacts first with a contour of the male rotor in association with rotation of the rotors is in a shape matched with a leading flank of the male rotor at the moment when the working chamber is isolated from the delivery port.

(3) The volume of the working chamber substantially becomes zero at the moment when the working chamber is isolated from the delivery port.

(4) A delivery final area of the delivery port is set to a location where the delivery port and the working chamber are isolated from each other at a progressed position of the rotating angle, and the area in the contour of the recessed part, that matched with the leading flank of the male rotor, is set in accordance with the leading flank of the male rotor at a further progressed position.

According to the screw compressor of the present invention explained above, an intermittent increase in torque can be reduced by preventing over-compression of a liquid until a volume of the working chamber substantially becomes zero from the timing immediately before the delivery completion of the liquid. Therefore, energy saving and reduction in vibration and noise can be achieved.

DETAILED DESCRIPTION OF THE PREFERRED EMBODIMENTS

Figure 1:
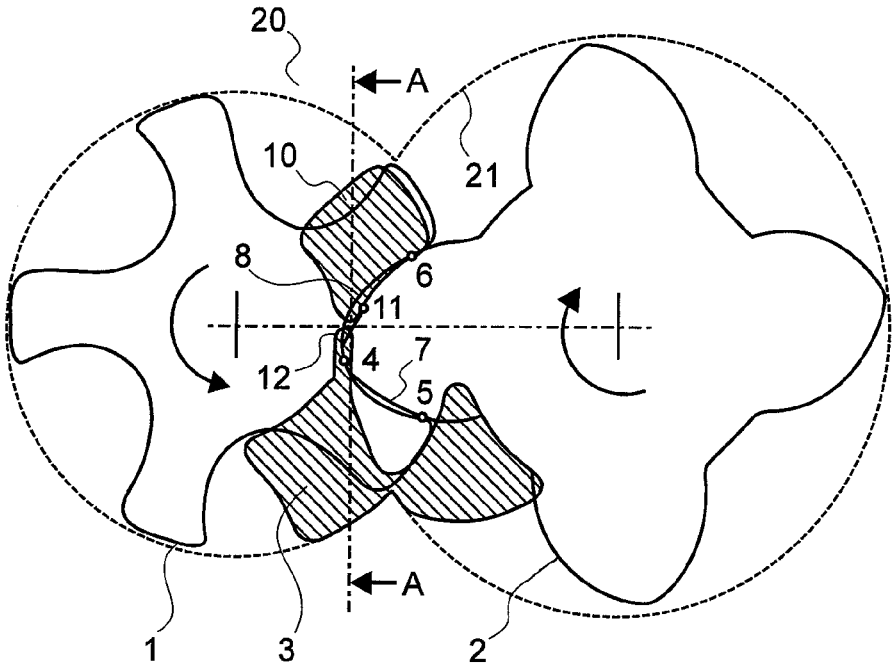
FIG. 1 is a cross-sectional view at the delivery end in the state immediately before the delivery completion of the screw compressor as the first embodiment of the present invention.

A plurality of preferred embodiments of the present invention will be explained below with reference to the accompanying drawings. The like reference numerals in each embodiment and the related art designate the like elements throughout the drawings.

First Embodiment

Figure 2:
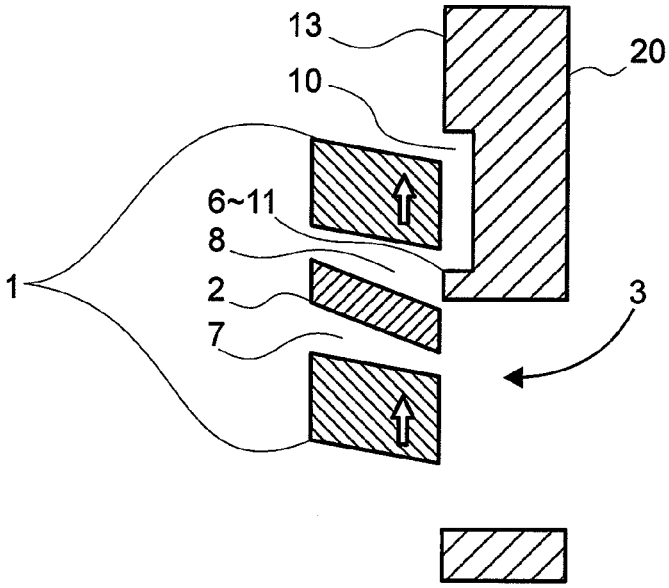
FIG. 2 is a cross-sectional view taken along A-A in FIG. 1.
Figure 3:
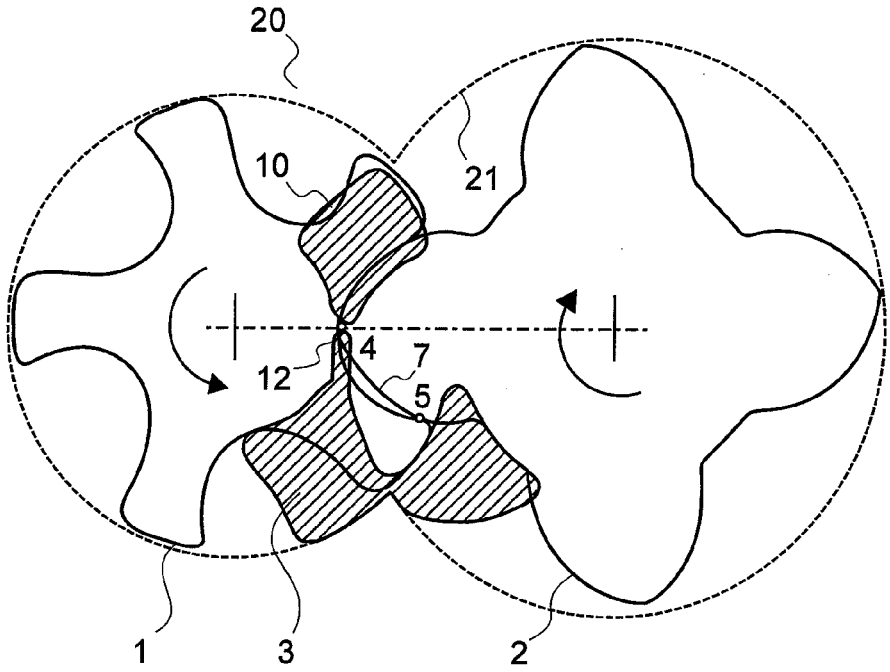
FIG. 3 is a cross-sectional view at the delivery end in the state where the rotating angle of the screw compressor in FIG. 1 is 0 degree.

A screw compressor of a first embodiment of the present invention will be explained with reference to FIG. 1 to FIG. 3. FIG. 1 is a cross-sectional view of the delivery end in the state immediately before the delivery completion of the screw compressor in the first embodiment of the present invention. FIG. 2 is a cross-sectional view taken along A-A in FIG. 1. FIG. 3 is a cross-sectional view of the delivery end in the state where a rotating angle of the screw compressor of FIG. 1 is zero degree.

The screw compressor of this embodiment is an oil-cooled screw compressor utilizing an ordinary oil as the liquid to be poured into a working chamber. Moreover, in this embodiment, a state of FIG. 3 where a tip of lobe of the male rotor 2 is located on a line connecting the centers of both rotors 1, 2 is defined as zero degree in terms of the rotating angles of the female rotor 1 and the male rotor 2, and the directions indicated by the arrow marks in FIG. 1 and FIG. 3 are defined as the positive rotating directions. Furthermore, in the case of the male rotor 2, in the two contours coupling between the tip and bottoms of a lobe, the one of which the normal line direction looks toward the rotating direction is defined with the terms of "leading flank". In the case of the female rotor 1, the one of which the normal line direction looks toward the inverse direction of the rotating direction is defined with the terms of "leading flank".

In the screw compressor, a pair of female rotor 1 and a male rotor 2 are accommodated within a bore 21 of a casing 20 indicated with a broken line to respectively rotate in the arrow mark direction, and are meshed with each other as shown in FIG. 1. With progress in rotation of both rotors 1 and 2, gas (air) within a groove operating as a working chamber is compressed, and is delivered to a delivery chamber (not shown) through a delivery port 3.

In the state shown in FIG. 1, both rotors 1, 2 are theoretically in contact with each other at the three locations of the points 4, 5, and 6 on the delivery end. Usually, the contact points 4, 5, and 6 are respectively provided with a small clearance in such a degree as not resulting in large internal leak in order to realize smooth rotation of both rotors 1 and 2. At the meshed area of both rotors 1 and 2, the working chamber 7 and the working chamber 8 are formed, and include the contact point 4 and the contact point 5, the contact point 4 and the contact point 6 at both ends thereof.

One working chamber 7 is formed in the adequate groove shape while those volumes are expanded in association with rotation of both rotors 1 and 2. This working chamber 7 is communicated with a suction port (not shown) at the other ends of both rotors 1, 2.

The other working chamber 8 is formed in the adequate groove shape that is gradually reduced in the volume. The oil is poured into this working chamber 8 in order to cool the gas in the compression process and to seal the clearance of the working chamber that is considered as a cause of internal leak. Accordingly, the gas mixed with the oil is compressed in the working chamber 8. In the delivery process, since the gas having the density smaller than that of the oil is delivered previously, the working chamber 8 is filled with the oil immediately before the delivery completion and the gas is almost ruled out.

A final delivery area 12 of the delivery port 3 is set at the area on the line connecting the centers of both rotors 1, 2 or at the area a little lower than such connecting line in FIG. 1. Moreover, a recessed part 10 is provided on the wall surface 13 of the casing 20 opposing to the rotor delivery end. An area of the contour of recessed part 10 (namely, a curve connecting the points 6 and 11) is set matching with the leading flank of the male rotor 2 at the location of minus 10 degrees in terms of the rotating angle of the male rotor 2. The contour of the other recessed part 10 is set matching with an arc having a diameter of lobe bottom diameter of the female rotor 1, the leading flank of the female rotor at the location of 60 degrees in terms of the rotating angle of the female rotor 1, and an arc having a diameter of lobe tip diameter of the female rotor 1. Therefore, the working chamber 8 is smoothly communicated with the recessed part 10 and a flowing resistance of oil to be delivered can be lowered.

The working chamber 8 is communicated with the recessed part 10 immediately before isolating from the delivery port 3. In other words, the working chamber 8 is communicated with both delivery port 3 and recessed part 10 immediately before the delivery completion. Communication between the working chamber 8 and the recessed part 10 is maintained until the volume of the working chamber 8 substantially becomes zero.

In the state shown in FIG. 2, the delivery port 3 is communicated with the working chamber 8, the working chamber 8 with the recessed part 10, and the recessed part 10 with the suction side, respectively.

Next, operations of the screw compressor of this embodiment will be explained. With rotation of both rotors 1 and 2, the working chamber 8 sucks the gas (air) from the atmosphere and then compresses the gas in combination with reduction of volume. The oil is poured to the working chamber 8 in the initial stage of the compression process. The working chamber 8 is subsequently communicated with the delivery port 3 to deliver the compressed air. Moreover, the working chamber 8 is communicated, immediately before the delivery completion, with the recessed part 10 via the line connecting the points 6 to 11 of the contour of the recessed part 10, while maintaining communication with the delivery port 3. In addition the working chamber 8 delivers the internal fluid thereof to the delivery port 3 and the recessed part 10 in accordance with reduction of volume thereof. In this case, since the fluid within the working chamber 8 is almost the oil because of the reason explained in the section of related art, almost no air is delivered to the suction side through the recessed part 10. Therefore, an internal leak does not increase due to the structure of this embodiment of the present invention and efficiency of operation is not likely to be reduced.

The working chamber 8 is always communicated, in the volume reducing process thereof, with at least any of the delivery port 3 and the recessed part 10 to stably acquire an oil delivery area. Therefore, rapid increase in resistance can be prevented when the oil is delivered. Therefore, since the oil in the working chamber 8 is delivered to the suction side without over-compression, remarkable increase in the drive torque of rotor due to over-compression of the oil can be prevented. Accordingly, not only energy saving can be realized, but also increment of vibration and noise level can also be prevented.

Here, the first embodiment of the present invention has been explained under the condition that the recessed part 10 is communicated with the suction side. However, in the case where the volume of the recessed part 10 is sufficiently larger than that of the working chamber 8 immediately before isolating from the delivery port 3, communication of the recessed part 10 with the suction side is not always required, when the working chamber 8 is communicated with the recessed part 10.

Moreover, the structure of this first embodiment can also be applied to the screw compressor where the volume of the working chamber substantially becomes zero at the moment when the working chamber is isolated from the delivery port.

Second Embodiment

Figure 4:
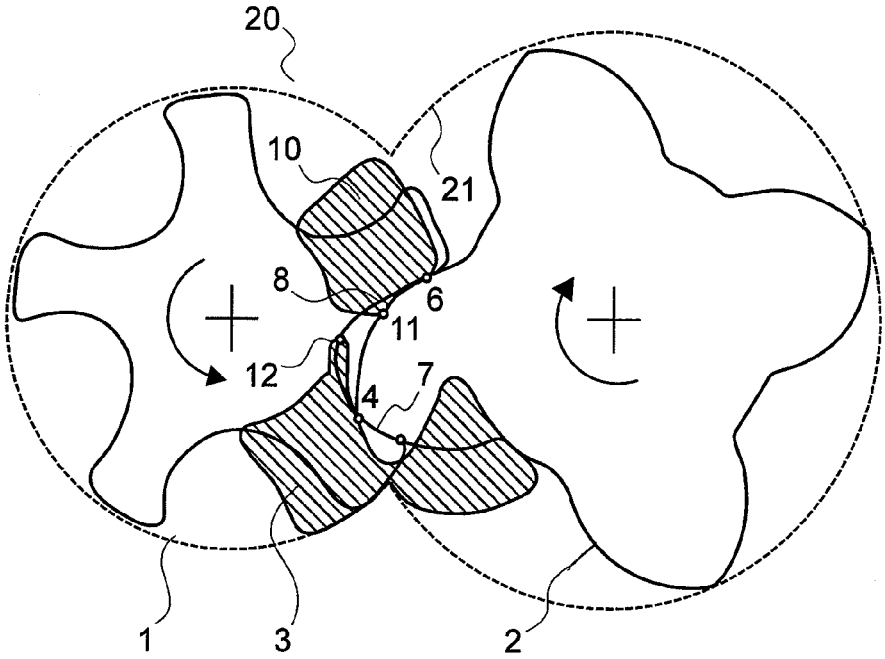
FIG. 4 is a cross-sectional view at the delivery end in the state immediately before the delivery completion of the screw compressor as the second embodiment of the present invention.
Figure 5:
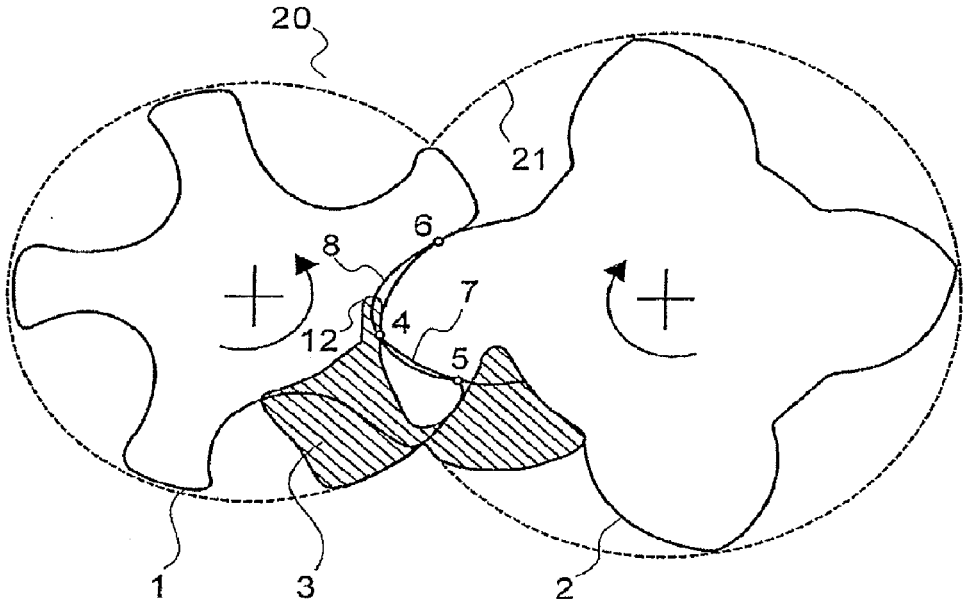
Related Art FIG.5
FIG. 5 is a cross-sectional view at the delivery end in the state immediately before the delivery completion of a general screw compressor in the related art.
Figure 6:
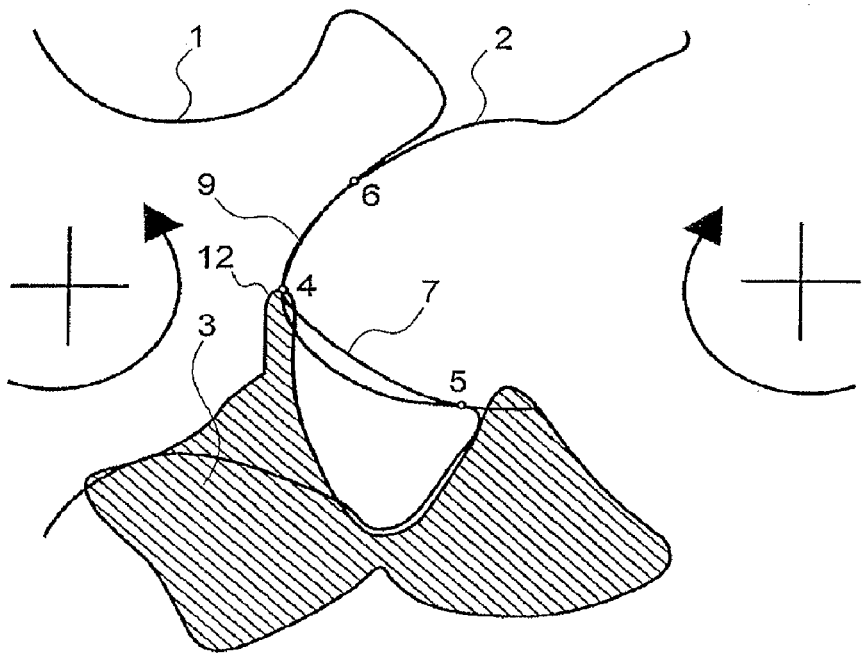
Related Art FIG.6
FIG. 6 is an enlarged cross-sectional view at the delivery end in the state at the moment of the delivery completion in FIG. 5.

Next, the screw compressor as the second embodiment of the present invention will be explained with reference to FIG. 4. FIG. 4 is a cross-sectional view at the delivery end in the state immediately before the delivery completion of the screw compressor as the second embodiment of the present invention. Since this second embodiment is different from the first embodiment in the contents explained below but is basically identical to the first embodiment in the other contents, duplicated explanation is eliminated here.

In this second embodiment, the delivery final area 12 of the delivery port 3 is set to the location where the delivery port 3 is isolated from the working chamber 8, at a location of minus 10 degrees in terms of the rotating angle of the male rotor 1. Moreover, an area of the contour of the recessed part 10, namely, a curve connecting the points 6 and 11 is set in accordance with the leading flank of the male rotor 2 at the location of the minus 20 degrees. Immediately before the delivery completion, the delivery port 3 is communicated with the working chamber 8, the working chamber 8 with the recessed part 10, and the recessed part 10 with the suction side, respectively.

According to the second embodiment, the time required for communication between the working chamber 7 communicated with the suction side and the delivery port 3 can be more reduced, in the rotating process of the rotors 1, 2, than that in the first embodiment. After the working chamber 8 is isolated from the delivery port 3, the oil remaining in the working chamber 8 is delivered to the suction side through the recessed part 10. Therefore, not only over-compression of oil in the working chamber 8 can be prevented, but also amount of air delivered to the working chamber 7 communicated with the suction side from the delivery port 3 can be reduced. Accordingly, operation efficiency of the screw compressor can be improved.

What is claimed is:

1. A screw compressor rotatably accommodating a pair of male and female rotors under the meshed state within a casing including a suction port and a delivery port to compress gas in the state of mixing a liquid through pouring of the liquid to the gas confined within a working chamber formed of both rotors and the casing, wherein: a recessed part is formed on a wall surface opposing to a rotor delivery end of the casing;

the working chamber is communicated with the recessed part immediately before isolating from the delivery port; and the communication is maintained until a volume of the working chamber substantially becomes zero.

2. The screw compressor according to claim 1, wherein the working chamber is isolated from the delivery port before the volume of the working chamber substantially becomes zero.

3. The screw compressor according to claim 1, wherein an area that is first in contact with a contour of the male rotor in association with rotation of both rotors among a contour of the recessed part is formed in a shape matched with a leading flank of the male rotor at the moment when the working chamber is isolated from the delivery port.

4. The screw compressor according to claim 3, wherein a delivery final area of the delivery port is set to a location where the delivery port and the working chamber are isolated from each other at a minus position of a rotating angle, and an area matched with the leading flank of the male rotor in the contour of the recessed part is set in accordance with the leading flank of the male rotor at the minus location of the rotating angle.

5. The screw compressor according to claim 1, wherein the volume of the working chamber substantially becomes zero at the moment when the working chamber is isolated from delivery port.

6. A screw compressor comprising:

a pair of male and female rotors;

a casing including a suction port and a delivery port, that forms a working chamber with the pair of male and female rotors;

a recessed part formed on a wall surface opposing to a rotor delivery end of the casing;

wherein the pair of male and female rotors are in a meshed state, within the casing;

wherein the screw compressor compresses gas while mixing a liquid, through pouring of the liquid to gas confined within the working chamber;

wherein the pair of male and female rotors, the recessed part, and the delivery port are arranged such that the working chamber is communicated with the recessed part immediately before isolation from the delivery port; and wherein the communication is maintained until a volume of the working chamber becomes substantially zero.

7. The screw compressor according to claim 6, wherein the working chamber is isolated from the delivery port before the volume of the working chamber becomes substantially zero.

8. The screw compressor according to claim 6, wherein at the moment when the working chamber is isolated from the delivery port, an area is formed in a shape matched with a leading flank of the male rotor, the area being previously in contact with a contour of the male rotor in association with rotation of both rotors among a contour of the recessed part.

9. The screw compressor according to claim 8, wherein a delivery final area of the delivery port is set to a location where the delivery port and the working chamber are isolated from each other at a minus position of a rotating angle, and an area matched with the leading flank of the male rotor in the contour of the recessed part is set in accordance with the leading flank of the male rotor at the minus location of the rotating angle.

10. The screw compressor according to claim 6, wherein the volume of the working chamber substantially becomes substantially zero at the moment when the working chamber is isolated from delivery port.

11. A screw compressor that compresses gas while mixing a liquid, through pouring of the liquid to gas confined within the working chamber, the screw compressor comprising:

a pair of male and female rotors in a meshed state, within a casing;

the casing, including a suction port and a delivery port;

a recessed part formed on a wall surface opposing to a rotor delivery end of the casing;

a working chamber formed by the casing and the pair of male and female rotors, the working chamber being configured to be communicated with the recessed part immediately before isolation from the delivery port, the communication being maintained until a volume of the working chamber becomes substantially zero.

12. The screw compressor according to claim 11, wherein the working chamber is isolated from the delivery port before the volume of the working chamber becomes substantially zero.

13. The screw compressor according to claim 11, wherein at the moment when the working chamber is isolated from the delivery port, an area is formed in a shape matched with a leading flank of the male rotor, the area being previously in contact with a contour of the male rotor in association with rotation of both rotors among a contour of the recessed part.

14. The screw compressor according to claim 11, wherein the volume of the working chamber substantially becomes substantially zero at the moment when the working chamber is isolated from delivery port.

15. The screw compressor according to claim 11, wherein a delivery final area of the delivery port is set to a location where the delivery port and the working chamber are isolated from each other at a minus position of a rotating angle, and an area matched with the leading flank of the male rotor in the contour of the recessed part is set in accordance with the leading flank of the male rotor at the minus location of the rotating angle.

* * * * *